US005394991A

United States Patent [19]

Kumagai et al.

[11] Patent Number: 5,394,991

[45] Date of Patent: Mar. 7, 1995

[54] CONDUCTIVE MATERIAL SORTING DEVICE

[75] Inventors: Masakatsu Kumagai, Aichi; Yoshihisa Fujita, Saitama, both of Japan

[73] Assignees: Toyota Tsusho Corporation; Toyota Metal Co., Ltd., both of Nagoya; Senko Kogyo Co., Ltd., Tokyo, all of Japan

[21] Appl. No.: 218,185

[22] Filed: Mar. 28, 1994

[30] Foreign Application Priority Data

Mar. 31, 1993 [JP] Japan ..... 5-098643

[51] Int. Cl.[6] ..... B03C 1/00

[52] U.S. Cl. ..... 209/212; 209/219

[58] Field of Search ..... 209/212, 219, 228, 229, 209/231

[56] References Cited

U.S. PATENT DOCUMENTS

| | | | |
|---|---|---|---|
| 2,745,549 | 5/1956 | Spodig | 209/219 |
| 2,992,733 | 7/1961 | Buus et al. | 209/219 |
| 4,834,870 | 5/1989 | Osterberg et al. | 209/212 X |
| 5,057,210 | 10/1991 | Julius | 209/219 X |
| 5,080,234 | 1/1992 | Benson | 209/219 X |
| 5,092,986 | 3/1992 | Feistner et al. | 209/219 X |
| 5,207,330 | 5/1993 | Siesco, Jr. | 209/219 |
| 5,236,136 | 8/1993 | McCarty et al. | 209/219 X |

FOREIGN PATENT DOCUMENTS

| | | |
|---|---|---|
| 4-150959 | 5/1992 | Japan . |
| 5-57212 | 3/1993 | Japan . |

*Primary Examiner*—D. Glenn Dayoan

*Attorney, Agent, or Firm*—Oblon, Spivak, McClelland, Maier, & Neustadt

[57] ABSTRACT

A conductive material sorting device includes a belt conveyer for supplying materials to be sorted, a roller wound with the belt conveyer, a magnet rotor inserted into the roller to be arranged at a portion of the roller wound with the belt conveyer and having a magnet arranged to alternate N and S poles with each other, and a drive device for rotationally driving the magnet rotor in the same direction as the roller and in the revere direction. An alternating magnetic field is generated by the rotation of the magnet rotor making it possible to send away conductive materials contained in the materials to be sorted along the most distant locus due to the repulsive force of a magnetic field caused by the eddy current generated in the conductive materials accompanying the generation of the alternating field.

19 Claims, 7 Drawing Sheets

CONDUCTIVE MATERIAL SORTING DEVICE

BACKGROUND OF THE INVENTION

1. Field of the Invention

This invention relates to a conductive material sorting device for sorting conductive materials contained in materials to be sorted by making it possible to send away the conductive materials along the most distant locus due to the repulsive force of a magnetic field caused by the generation of eddy current accompanying the alternating magnetic field resulting from the rotation of a magnet rotor.

2. Description of the Invention

As shown in FIG. 7, a conventional conductive material sorting device has been adapted to rotationally drive a roller R and a magnet rotor M in the same direction as a belt conveyer B for supplying materials to be sorted.

Since the conventional device is adapted to rotationally drive the magnet rotor M in the same direction as the belt conveyer B for supplying the materials to be sorted, it involves such a problem that the materials to be sorted are rolled in the reverse direction to the moving direction of the belt conveyer B in dependence upon the kind and size of the conductive materials to exert a bad influence upon the sorting of materials to be sorted into the conductive materials and others.

SUMMARY OF THE INVENTION

An object of the present invention is to make it possible to sort out conductive materials.

Another object of the present invention is to effectively sort out conductive materials irrespective of the kind and size of the conductive materials.

A further object of the present invention is to effectively sort out conductive metals, magnetic materials, nonmetals and dust.

A still further object of the present invention is to make it possible to sort out conductive metals by utilizing the repulsive force of a magnetic field caused by the eddy current generated in the conductive metals due to an alternating field.

A yet further object of the present invention is to prevent materials to be sorted from rolling along a belt conveyer to the upstream side by the magnetic force of a magnet rotor.

A yet further object of the present invention is to provide a conductive material sorting device for controlling the rotational direction of a magnet rotor to be reverse to the moving direction of a belt conveyer according to the size of materials to be sorted.

A yet further object of the present invention is to provide a conductive material sorting device comprising a belt conveyer for supplying materials to be sorted, a roller wound with the belt conveyer, a magnet rotor inserted into the roller to be arranged at a portion of the roller wound with the belt conveyer and having a magnet arranged to alternate N and S poles with each other and a drive device for rotationally driving the magnet rotor in the same direction as the roller and in the reverse direction thereto, wherein an alternating magnetic field is generated by the rotation of the magnet rotor to make it possible to send away conductive materials contained in the materials to be sorted along the most distant locus due to the repulsive force of a magnetic field caused by the eddy current generated in the conductive materials accompanying the generation of the alternating field.

A yet further object of the present invention is to provide a conductive material sorting device constituted such that the diameter of the magnet rotor is made sufficiently smaller than that of the roller, the magnet rotor is arranged to be in contact with the upper inside wall of the roller to define a sufficient gap between the lower portion of the magnet rotor and the lower inside wall of the roller, the distance between the magnet of the magnet rotor and magnetic materials moved to the lower side of the roller along the outer wall of the roller while coming into contact with the belt conveyer due to the attraction force of the magnet of the magnet rotor is enlarged, and as a result, the attraction force of the magnet becomes weak to make it possible to drop the magnetic materials downwards.

A yet further object of the present invention is to provide a conductive material sorting device further comprising a vibration feeder arranged on the upstream side of the belt conveyer and supported by spring members, wherein supplied materials to be sorted are diffused on the vibration feeder to make it possible to successively supply the diffused materials to be sorted to the belt conveyer.

A yet further object of the present invention is to provide a conductive material sorting device further comprising a magnetic drum separator arranged on the upstream side of the belt conveyer and having a magnet provided on the outer periphery, wherein ferrous materials or nonferrous metals with ferrous materials and other magnetic materials contained in materials to be sorted are adsorbed and sorted to make it possible to supply the materials to be sorted other than the magnetic materials to the belt conveyer.

Since the magnet rotor is rotated in the reverse direction by the drive device when the materials to be sorted are supplied to the magnet rotor through the belt conveyer, the conductive material sorting device of the present invention is adapted to effectively send away the conductive materials along the most distant locus by causing the materials to be sorted to roll in the moving direction of the belt conveyer by the rotation of the magnet rotor in the reverse direction according to the kind and size of the materials to be sorted without exerting a bad influence upon the sorting of materials to be sorted into the conductive materials and others.

Since the magnet rotor having a small diameter is arranged on the upper portion of the roller, the conductive material sorting device of the present invention is adapted to enlarge the distance between the magnet of the magnet rotor and the magnetic materials moved to the lower side of the roller along the outer wall of the roller while coming into contact with the belt conveyer due to the attraction force of the magnet of the magnet rotor, and as a result, the attraction force of the magnet becomes weak to make it possible to drop the magnetic materials downwards.

Since the supplied materials to be sorted are diffused by the vibration feeder and successively supplied to the belt conveyer, the conductive material sorting device of the present invention is adapted to uniformly supply the materials to be sorted to the magnet rotor.

According to the conductive material sorting device of the present invention, the magnetic materials contained in the supplied materials to be sorted are adsorbed and sorted in advance by the magnetic drum separator, and the remaining materials to be sorted are supplied to the belt conveyer.

The conductive material sorting device of the present invention has the effect of effectively sorting out the conductive materials irrespective of the kind and size of the conductive materials.

The conductive material sorting device of the present invention has the effect of facilitating the operation of separating the magnetic materials from the belt conveyer.

The conductive material sorting device of the present invention has the effect of improving the sorting accuracy of the conductive materials, since the materials to be sorted are uniformly supplied to the roller and the magnet rotor.

The conductive material sorting device of the present invention has the effect of making it possible to shorten the operation of sorting out the magnetic materials by the magnet rotor for effectively sorting out the conductive materials, since the magnetic materials are removed in advance by the magnetic drum separator.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
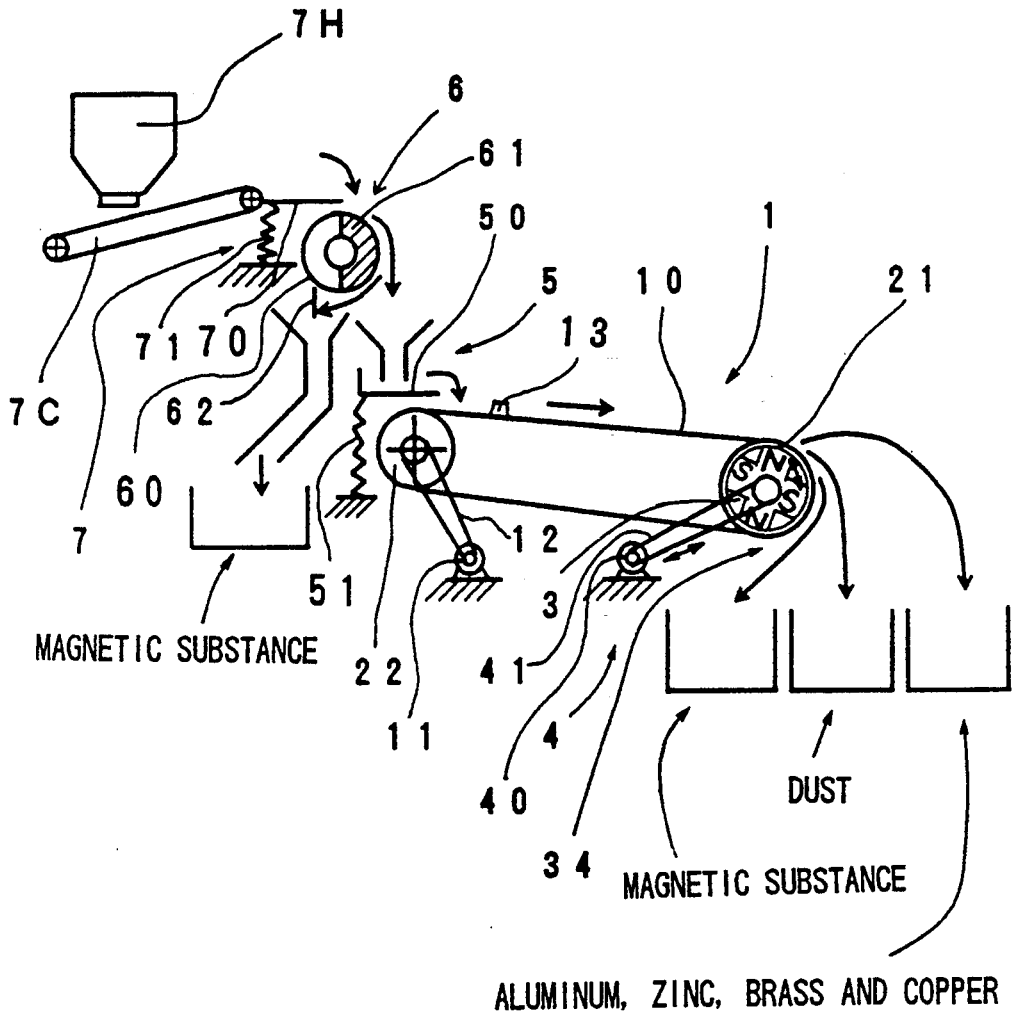
FIG. 1 is a block diagram showing a conductive material sorting device as a first preferred embodiment of the present invention.

As shown in FIGS. 1 to 4, a conductive material sorting device as a first preferred embodiment of the present invention comprises an endless belt conveyer 1 arranged with an inclination and for supplying materials to be sorted, first and second rollers 21 and 22 arranged on both ends of the belt conveyer 1 and wound with the belt conveyer 1 around the outer periphery, a magnet rotor 3 coaxially inserted into the first roller 21 and having a magnet 31 arranged to alternate N and S poles with each other, a drive device 4 constituted by a motor 40 for rotationally driving the magnet rotor 3 in the same direction as the first roller 21 and in the reverse direction thereto, a second vibration feeder 5 arranged on the upstream side of the belt conveyer 1 and for successively supplying materials to be sorted in a diffused state by applying the vibration to the materials to be sorted, a magnetic drum separator 6 arranged on the upstream side of the second vibration feeder 4 and having a magnet provided on the outer periphery for adsorbing and sorting out magnetic materials, and a first vibration feeder 7 arranged on the upstream side of the magnetic drum separator 6 and for successively supplying the materials to be sorted in a diffused state by applying the vibration to the materials to be sorted supplied through a conveyer.

The first vibration feeder 7 is constituted by a plate-like member 70 supported by spring members 71 from the underside and applied with the vibration by a vibrating device which makes an eccentric motion. When the materials to be sorted stored in a hopper 7H are supplied to the first vibration feeder 7 through a conveyer 7C, the first vibration feeder 7 applies the vibration to the materials to be sorted, which are then diffused on the plate-like member 70 and supplied in such a diffused state to the magnetic drum separator 6.

The magnetic drum separator 6 is constituted by a drum 60 having a rare-earth magnet 61 provided on the outer periphery and rotationally driven by a motor 63. When the materials to be sorted are supplied in the diffused state to the magnetic drum separator 6 by the first vibration feeder 7, the magnetic drum separator 6 adsorbs ferrous materials, nonferrous metals with ferrous materials and other magnetic materials from the supplied materials to be sorted by the rare-earth magnet 61, then separates the adsorbed materials from the drum 60 by a separation plate 62 arranged below the drum and drops the separated materials downwards.

The second vibration feeder 5 is constituted by a plate-like member 50 supported by spring member 51 from the underside and applied with the vibration by a vibrating device which makes an eccentric motion. When the nonferrous materials are naturally dropped to the second vibration feeder 5 without being adsorbed by the magnetic drum separator 6, the second vibration feeder 5 applies the vibration to such naturally dropped nonferrous materials, which are then diffused on the plate-like member 50 and supplied in such a diffused state to the belt conveyer 1.

The belt conveyer 1 is constituted by an endless belt member 10 constant in width and provided with a resin crosspiece member 13 having a trapezoidal section and arranged on one portion. The belt conveyer 1 is rotated clockwise by rotationally driving the second roller 22 by a motor 11 through a belt 12, while the first roller 21 as a driven roller is rotationally driven by the belt conveyer 1, so that the materials to be sorted supplied in the diffused state from the second vibration feeder 5 are successively supplied rightwards in the drawing. The crosspiece member 13 is adapted to drop downwards the magnetic materials remaining on the belt conveyer 1 at a portion corresponding to the lower portion of the magnet rotor 3 without being dropped downwards by transferring such remaining magnetic materials to the tip end of the crosspiece member 13 to enlarge the distance between the remaining magnetic materials and the magnet of the magnet rotor 3 every time the crosspiece member 13 makes one rotation to reach the remaining magnetic materials.

The magnet rotor 3 is constituted by a rare-earth magnet 31, which is compact in size, has large magnetic force and contains inexpensive neodymium, and the rare-earth magnet 31 is arranged in the radial direction to alternate N and S poles with each other. The magnet rotor 3 is coaxially arranged in the first roller 21, and rotationally driven through a belt 41 by a reversible motor 40 constituting the drive device 4 adapted to change over the rotational direction.

Figure 2:
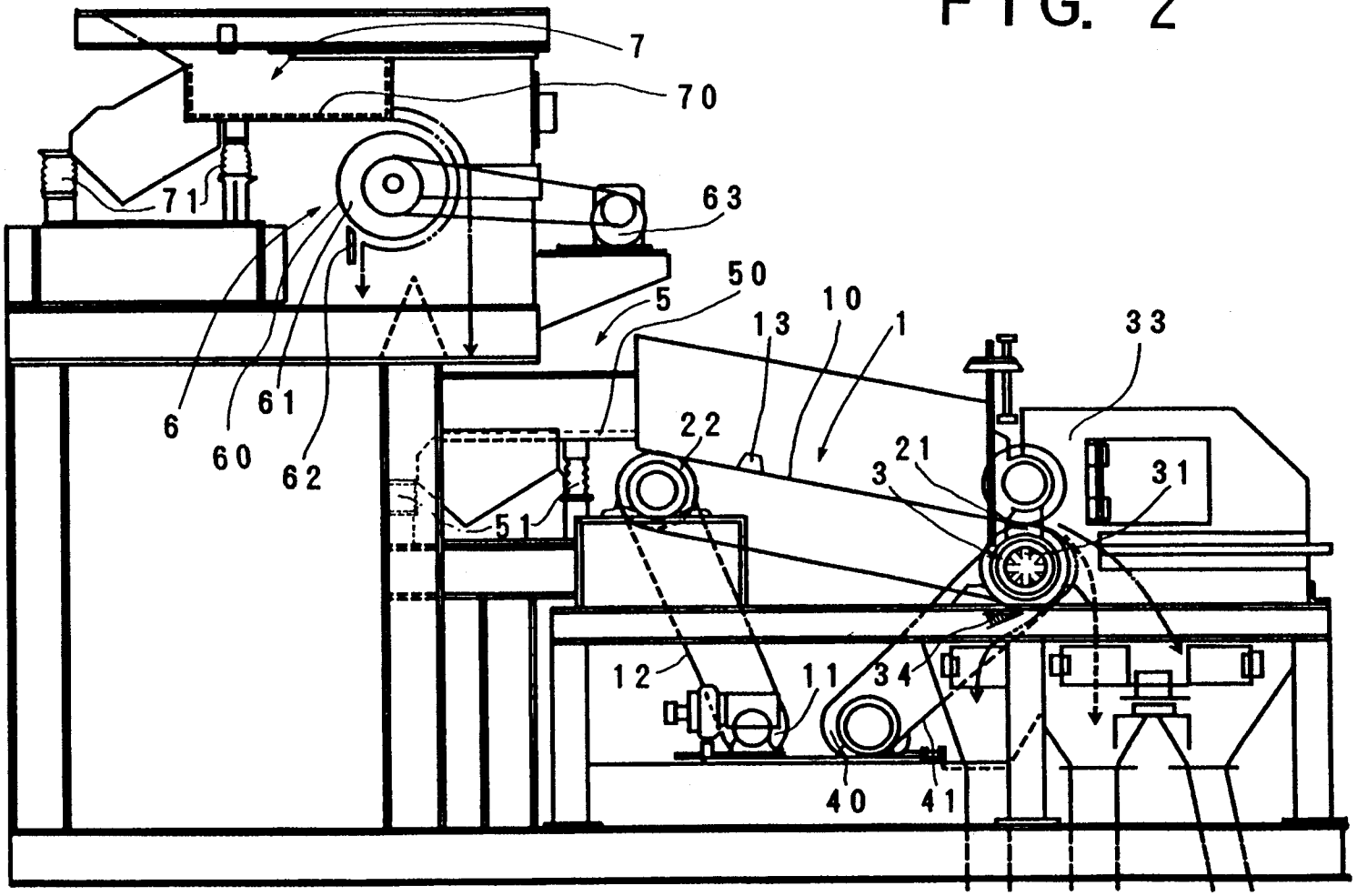
FIG. 2 is a side view showing the conductive material sorting device as the first preferred embodiment.

In case of sorting the materials to be sorted having the size and not less than 20 mm, the magnet rotor 3 is rotationally driven by the reversible motor 40 of the drive device 4 in the same direction as the belt conveyer 1, while in case of sorting the materials to be sorted having the size of not more than 20 mm, the magnet rotor 3 is rotationally driven by the reversible motor 40 in the reverse direction to the belt conveyer 1. As shown in FIG. 2, a cover plate 33 is arranged between the magnet rotor 3 and accommodating cases of the sorted materials and adapted to prevent the sorted materials from flying away. Further, instead of the crosspiece member 13 provided on the belt conveyer 1, a separation member 34 having a wedgy cross section may be arranged below the magnet rotor 3 to promote the separation of the conductive materials from the belt conveyer 1.

Figure 3:
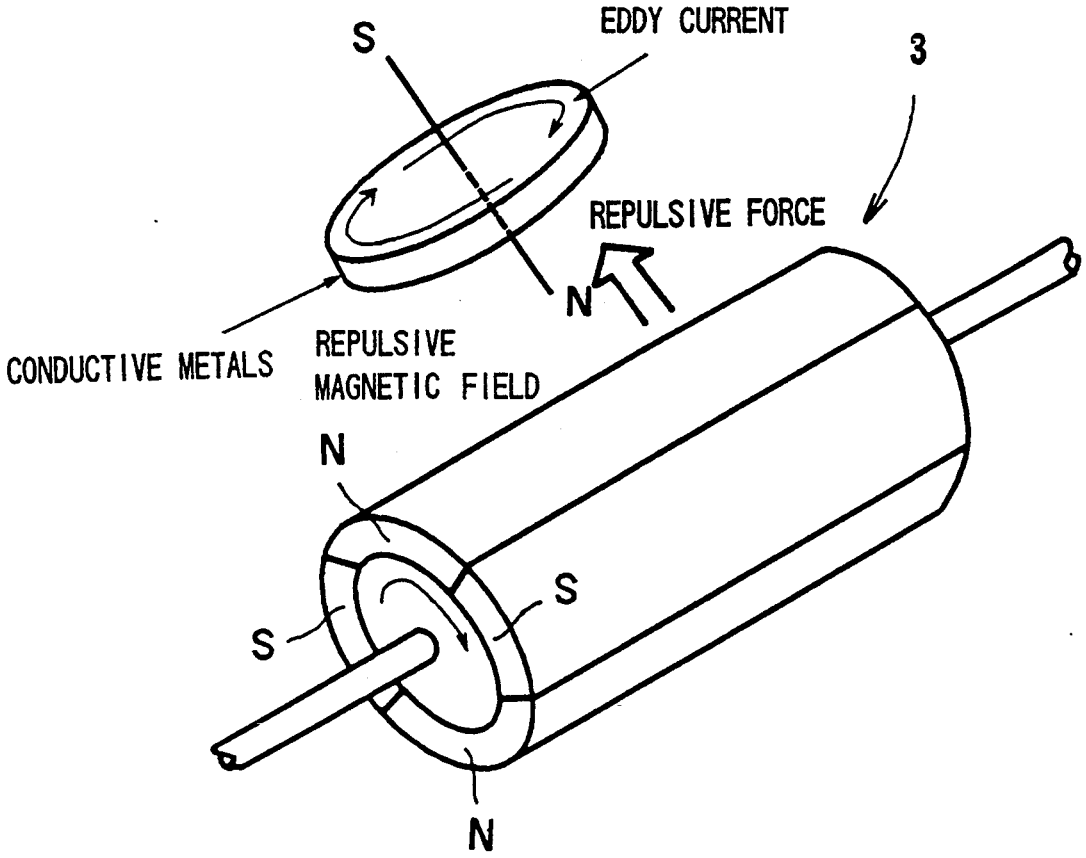
FIG. 3 is a perspective view showing the sorting principle of a magnet rotor of the conductive material sorting device as the first preferred embodiment.

The principle of sorting the conductive substance in the magnet rotor 3 is as follows. When the conductive metal is placed within an alternating magnetic field as shown in FIG. 3, eddy induced current is generated on the surface of the conductive metal, and thus a repulsive magnetic field repulsing the alternating magnetic field is generated within the conductive metal due to the induced current. When a series of permanent magnets arranged to alternate N and S poles with each other are provided on the outer periphery of the magnet rotor 3 and then the magnet rotor 3 is rotated, the alternating magnetic field is generated. When the conductive metal is placed within the alternating magnetic field as shown in FIG. 3, looped eddy current flows through the conductive metal. Since the magnetic field produced by the eddy current always results in the same pole as the alternating magnetic field of the magnet rotor 3 as shown in FIG. 3, the conductive metal is instantaneously repulsed to be sent away along a locus apart from the roller. On the other hand, since the alternating magnetic field has no effect on nonconductive materials, the nonconductive materials are dropped downward along a normal locus of natural drop due to the own weight to be separated from the conductive metal described above.

As described above, according to the view of the present inventors, in case where the conductive materials having the size of not more than 20 mm, for example, are the materials to be sorted, when the magnet rotor 3 is rotated clockwise, i.e., in the same direction as the belt conveyer 1, some conductive materials are rolled in the reverse direction to the belt conveyer 1. In this connection, the first preferred embodiment of the present invention is characterized in that the conductive materials conventionally rolled in the reverse direction are varied to roll clockwise (i.e., in the moving direction of the belt conveyer 1) by rotating the magnet rotor 3 counterclockwise, i.e., in the reverse direction to the belt conveyer 1.

Figure 4:
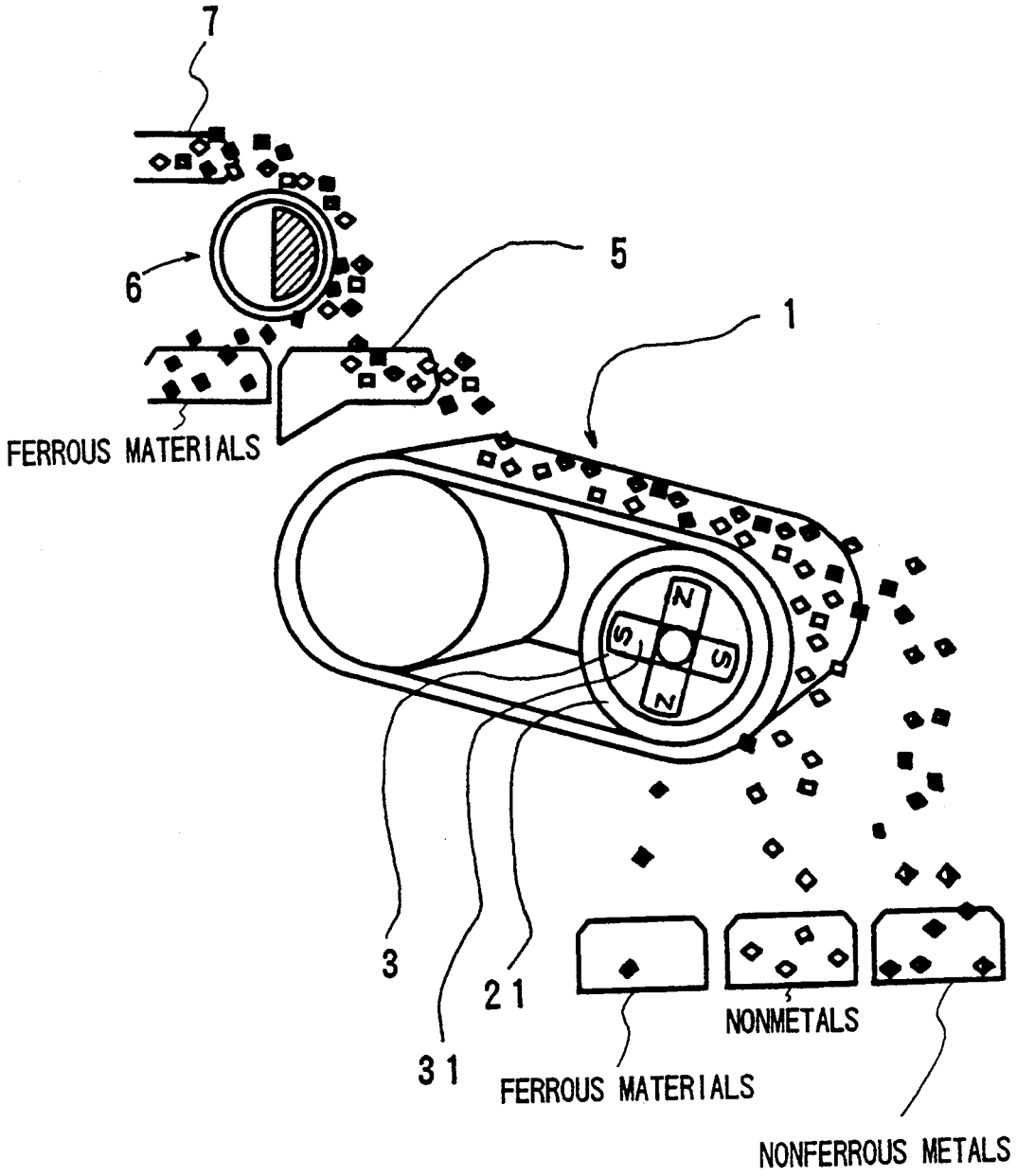
FIG. 4 is a perspective view for explaining the operation of the conductive material sorting device as the first preferred embodiment.

The conductive material sorting device as the first preferred embodiment constituted as described above is operated as follows. As shown in FIG. 4, the materials to be sorted supplied through the conveyer 7C are diffused and supplied in a diffused state by the first vibration feeder 7, and then the ferrous and other magnetic materials are adsorbed and sorted from the materials to be sorted by the magnetic drum separator 6. The materials to be sorted other than the sorted magnetic materials are diffused and supplied in a diffused state to the belt conveyer 1 by the second vibration feeder 5. Then, the diffused materials to be sorted are successively supplied to the magnet rotor 3 through the belt conveyer 1. The eddy current is generated in the conductive metal contained in the materials to be sorted by the magnet rotor 3 due to the alternating filed of the magnet rotor 3, so that the conductive metals are send away to and accommodated in a conductive metal accommodation case located at the most distant from the magnet rotor 3 due to the repulsive force of the repulsive magnetic field accompanying the generation of eddy current, the nonconductive materials are naturally dropped downwards due to the own weight and then accommodated in a middle nonconductive material accommodation case, and the partially remaining magnetic materials are adsorbed to the rare-earth magnet 31 of the magnet rotor 3 and then dropped below the magnet rotor 3 to be accommodated in a magnetic material accommodation case. The conductive materials having the size of not more than 20 mm are made to roll in the moving direction of the belt conveyer 1, while preventing from rolling in the reverse direction by rotating the magnet rotor 3 counterclockwise. The magnetic materials staying on the lower portion of the magnet rotor 3 without being dropped are dropped downwards by the crosspiece member 13 of the belt conveyer 1.

The conductive material sorting device as the first preferred embodiment having the operation described above has the effect of making it possible to effectively sort out the conductive materials irrespective of the kind and size of the materials to be sorted, since even the materials to be sorted having the size of not more than 20 mm are effectively sorted so as to rolled in the moving direction of the belt conveyer 1.

Further, the conductive material sorting device as the first preferred embodiment has the effect of improving the sorting accuracy of the materials to be sorted in the magnetic drum separator 6 and the magnet rotor 3, since the materials to be sorted are diffused and then supplied in a diffused state to the magnetic drum separator 6 and the magnet rotor 3 by the first and second vibration feeders 1 and 2, respectively.

Furthermore, the conductive material sorting device as the first preferred embodiment has the effect of effectively sorting out the conductive materials by the magnet rotor 3, while lengthening the life of the belt conveyer 1, since the magnetic materials are sorted and removed in advance by the magnetic drum separator 6.

Moreover, the conductive material sorting device as the first preferred embodiment has the effect of preventing the materials to be sorted from rolling along the belt conveyer 1 to the upstream side due to the magnetic force of the magnet rotor, since the belt conveyer is arranged with an inclination.

Figure 5:
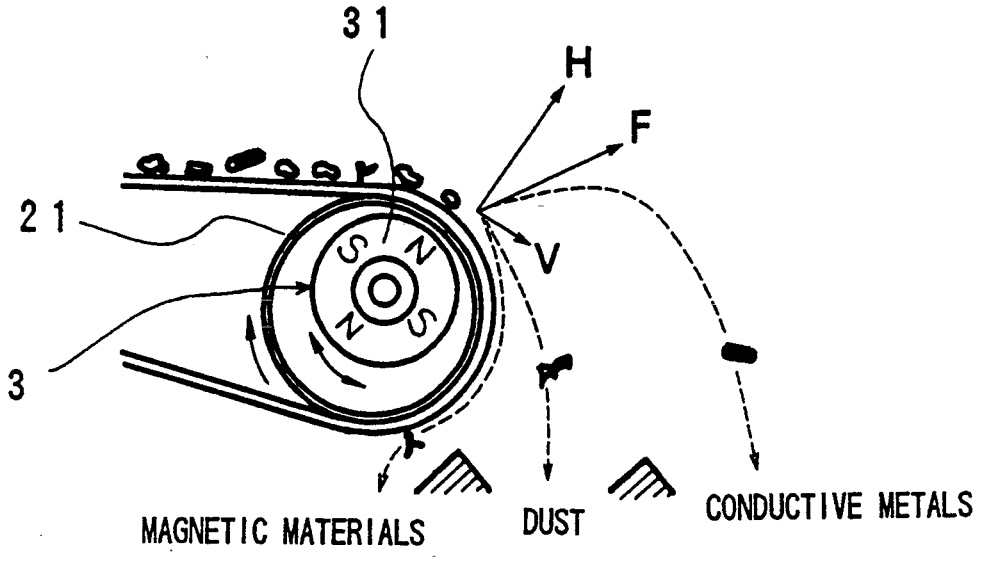
FIG. 5 is a side view showing a first roller and a magnet rotor of a conductive material sorting device as a second preferred embodiment of the present invention.

A conductive material sorting device as a second preferred embodiment of the present invention is different from the device as the first preferred embodiment in points as follows. Namely, the first roller 21 and the magnet rotor 3 are coaxially arranged in the first preferred embodiment, whereas in the second preferred embodiment, the diameter of the magnet rotor 3 is made sufficiently smaller than that of the first roller 21, and the magnet rotor 3 is arranged to be in contact with the upper inside wall of the first roller so as to define a sufficient gap between the magnet rotor 3 and the lower inside wall of the first roller 21, as shown in FIG. 5. Thus, when the magnet materials adsorbed by the magnetic adsorption force of the rare-earth magnet 31 of the magnet rotor 3 are described through the belt conveyer 1 along the first roller 21 to reach the lower portion of the first roller 21, the distance between the magnetic materials and the rare-earth magnet 31 of the magnet rotor 3 is enlarged, and thus the magnetic adsorption force is reduced to drop the magnetic materials from the lower portion of the first roller 21 to a magnetic material dropping area. Therefore, the conductive material sorting device as the second preferred embodiment dispenses with the crosspiece member 31 and the separation member 34 in the first preferred embodiment. Incidentally, other constitution, operation and effects are similar to those of the first preferred embodiment.

The preferred embodiments described above are illustrative and not restrictive, and it is to be understood that other embodiments and modifications are possible without departing from the technical concept of the invention which will be recognized by those skilled in the art on the basis of the claims, the description of the invention and the drawings.

Figure 6:
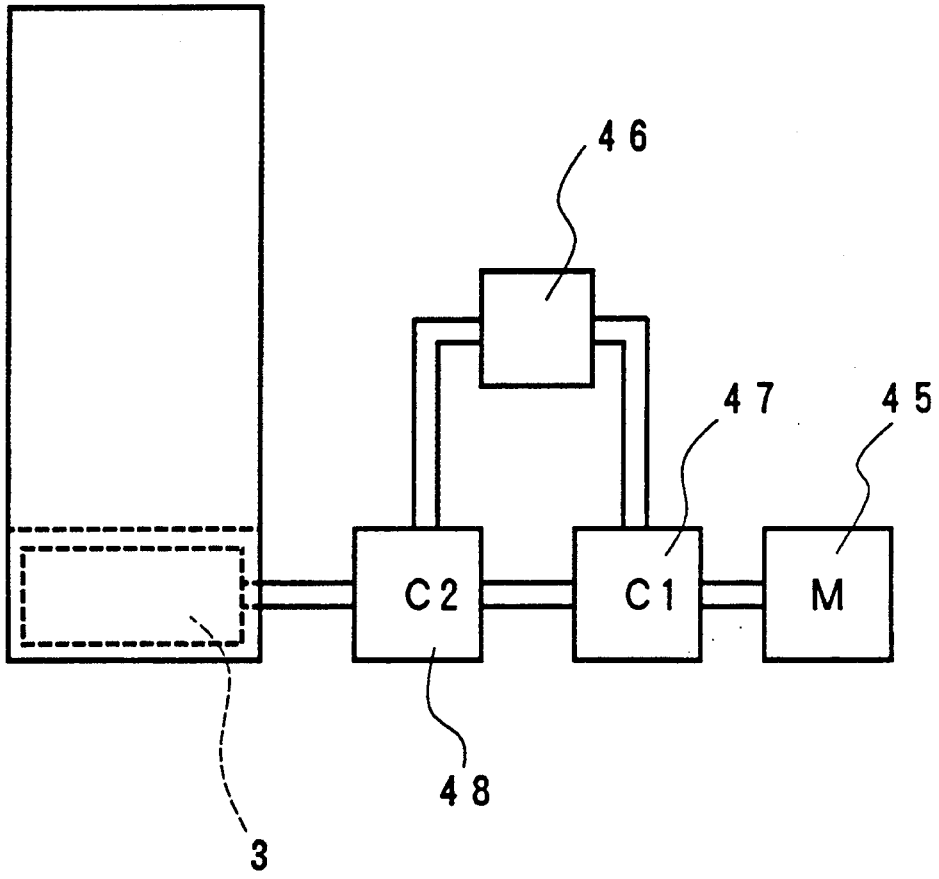
FIG. 6 is a block diagram showing a modification of a drive device.
Figure 7:
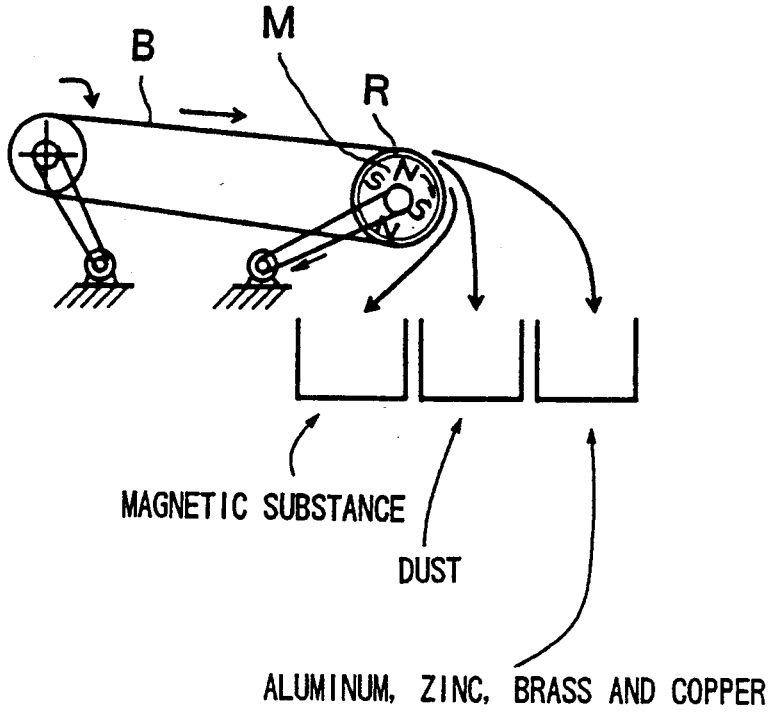
FIG. 7 (PRIOR ART)
FIG. 7 is a block diagram showing a prior art conductive material sorting device.

In the preferred embodiments described above, the reversible motor 40 adopted as the drive device 4 is illustrative and not restrictive, and it is to be understood that the drive device is additionally provided with a reverse mechanism capable of connecting the rotation to a motor rotating only in one direction as shown in FIG. 6, so that the reverse mechanism is operated when the rotation in the reverse direction is required.

What is claimed is:

1. A conductive material sorting device, comprising:
a belt conveyer for supplying materials to be sorted;
a roller wound with the belt conveyer;
a magnet rotor inserting into the roller to be arranged at a portion of the roller wound with the belt conveyer and having a magnet arranged to alternate N and S poles with each other; and
a drive device for rotationally driving the magnet rotor in the same direction as said roller and in the reverse direction thereto;
wherein an alternating magnetic field is generated by the rotation of the magnet rotor to make it possible to send away conductive materials contained in the materials to be sorted along the most distant locus due to the repulsive force of a magnetic field caused by the eddy current generated in the conductive materials accompanying the generation of the alternating field.

2. A conductive material sorting device according to claim 1, wherein
said drive device controls the rotational direction of said magnet rotor according to the size of the materials to be sorted.

3. A conductive material sorting device according to claim 1, wherein
said drive device rotationally drives said magnet rotor in the reverse direction to said roller when the size of the materials to be sorted is not more than a predetermined size.

4. A conductive material sorting device according to claim 1, wherein
said drive device is constituted by a reversible motor capable of rotationally driving said magnet rotor in the reverse direction to said roller when the size of the materials to be sorted is not more than 20 mm.

5. A conductive material sorting device according to claim 1, wherein
said belt conveyer is constituted by an endless belt member having a fixed width, and a second roller which is rotationally driven by a motor through a belt.

6. A conductive material sorting device according to claim 1, further comprising:
a crosspiece member arranged on a longitudinal portion of said belt conveyer and for dropping magnetic materials remaining over in the width direction without being dropped.

7. A conductive material sorting device according to claim 5, wherein
said magnet rotor has said magnet arranged in the radial direction so as to alternative N and S poles with each other, and is coaxially arranged in the second roller.

8. A conductive material sorting device according to claim 7, wherein
said magnet of said magnet rotor is constituted by a rare-earth magnet containing neodymium.

9. A conductive material sorting device according to claim 1, wherein
the diameter of said magnet rotor is made sufficiently smaller than that of the roller, said magnet rotor is arranged to be in contact with the upper inside wall of the roller to define a sufficient gap between the lower portion of the magnet rotor and the lower inside wall of the roller, the distance between the magnet of the magnet rotor and the magnetic materials moved to the lower side of the roller along the outer wall of the roller while coming into contact with the belt conveyer due to the attraction force of the magnet of the magnet rotor is enlarged, and as a result, the attraction force of the magnet becomes weak to make it possible to drop the magnetic materials downwards.

10. A conductive material sorting device according to claim 1, further comprising:
a first vibration feeder arranged on the upstream side of the belt conveyer and supported by spring members;
wherein the supplied materials to be sorted are diffused on said first vibration feeder to make it possible to successively supply the diffused materials to be sorted to the belt conveyer.

11. A conductive material sorting device according to claim 1, further comprising:
a magnetic drum separator arranged on the upstream side of the belt conveyer and having a magnet provided on the outer periphery;
wherein ferrous materials or nonferrous metals with ferrous materials and other magnetic materials contained in the materials to be sorted are absorbed and sorted to make it possible to supply the materials to be sorted other than the magnetic materials to the belt conveyer.

12. A conductive material sorting device according to claim 11, further comprising:
a second vibrator feeder arranged on the upstream side of said magnetic drum separator and supported by spring members;
wherein the supplied materials to be sorted are diffused on said second vibration feeder to make it possible to successively supply the diffused materials to be sorted to said magnetic drum separator.

13. A conductive material sorting device according to claim 10, wherein
said first vibration feeder is constituted by a plate-like member applied with the vibration by a vibrating device which makes an eccentric motion.

14. A conductive material sorting device according to claim 11, wherein said magnetic drum separator comprises a drum having a rare-earth magnet provided on the outer periphery and rotationally driven by the motor, and a separation plate for separating the adsorbed magnetic materials.

15. A conductive material sorting device according to claim 12, wherein said second vibration feeder is constituted by a plate-like member applied with the vibration by a vibrating device which makes an eccentric motion.

16. A conductive material sorting device according to claim 6, wherein said crosspiece member is constituted by a synthetic resin member having a trapezoidal section and makes it possible to drop downwards the magnetic materials remaining on the belt conveyer at a portion corresponding to the lower portion of said magnet rotor without being dropped, every time said crosspiece member reaches the remaining magnetic materials.

17. A conductive material sorting device according to claim 11, wherein said first vibration feeder is arranged below said magnetic drum separator.

18. A conductive material sorting device according to claim 5, wherein said belt conveyer is arranged with an inclination at a fixed angle such as to make the downstream side lower than the upstream side, and prevents the materials to be sorted from rolling along said belt conveyer to the upstream side due to the magnetic force of said magnet rotor.

19. A conductive material sorting device according to claim 3, wherein said drive device is provided with a reverse mechanism capable of engaging the rotor.

* * * * *